US007545348B2

(12) United States Patent
Tseng et al.

(10) Patent No.: US 7,545,348 B2
(45) Date of Patent: Jun. 9, 2009

(54) PIXEL UNIT AND DISPLAY AND ELECTRONIC DEVICE UTILIZING THE SAME

(75) Inventors: Chang-Ho Tseng, Houjhuang Village (TW); Yu-Chun Shih, Taichung (TW); Hsuan-Chih Huang, Hemu Village (TW)

(73) Assignee: TPO Displays Corp., Miao-Li County (TW)

( * ) Notice: Subject to any disclaimer, the term of this patent is extended or adjusted under 35 U.S.C. 154(b) by 649 days.

(21) Appl. No.: 11/326,245

(22) Filed: Jan. 4, 2006

(65) Prior Publication Data

US 2007/0152919 A1 Jul. 5, 2007

(51) Int. Cl.
*G09G 3/30* (2006.01)

(52) U.S. Cl. ..... 345/76; 345/82; 345/87; 345/92

(58) Field of Classification Search ..... 345/36, 345/38–39, 45, 76–78, 82–84, 87–88, 90–95, 345/98–100, 204–205, 210–214; 315/169.1, 315/169.3; 340/815.45
See application file for complete search history.

(56) References Cited

U.S. PATENT DOCUMENTS 6,229,506 B1 * 5/2001 Dawson et al. ..... 345/82
6,583,581 B2 * 6/2003 Kaneko et al. ..... 315/169.3
6,618,030 B2 * 9/2003 Kane et al. ..... 345/82
6,903,731 B2 * 6/2005 Inukai ..... 345/204
6,919,886 B2 * 7/2005 Sato et al. ..... 345/205
7,259,735 B2 * 8/2007 Kasai ..... 345/77
7,317,435 B2 * 1/2008 Hsueh ..... 345/82
2003/0052843 A1 * 3/2003 Yamazaki et al. ..... 345/82
2004/0056252 A1 * 3/2004 Kasai ..... 257/72
2005/0052377 A1 3/2005 Hsueh ..... 345/82
2005/0140600 A1 * 6/2005 Kim et al. ..... 345/76

FOREIGN PATENT DOCUMENTS

CN 1543637 11/2004
CN 1659617 8/2005

OTHER PUBLICATIONS

CN Office Action mailed Feb. 1, 2008.

* cited by examiner

*Primary Examiner*—Richard Hjerpe
*Assistant Examiner*—Mansour M Said
(74) *Attorney, Agent, or Firm*—Thomas, Kayden, Horstemeyer & Risley

(57) ABSTRACT

A pixel unit. A first thin film transistor comprises a first control terminal receiving a scan signal, a first electrode receiving a data signal, and a second electrode. A second thin film transistor comprises a second control terminal coupled to the second electrode, a third electrode receiving a first voltage, a fourth electrode, and a fifth electrode coupled to one of the third and the fourth electrodes. A capacitor is coupled between the second control terminal and the third electrode. A light-emitting device is coupled between the fourth electrode and a second voltage.

8 Claims, 5 Drawing Sheets

PIXEL UNIT AND DISPLAY AND ELECTRONIC DEVICE UTILIZING THE SAME

BACKGROUND

The disclosure relates to a pixel unit, and more particularly to a pixel unit having thin-film transistors.

FIG. 1 is a schematic diagram of a conventional pixel unit. A thin-film transistor (TFT) 101 comprises a gate receiving a scan signal S1, a drain receiving a data signal D1, and a source. A TFT 103 comprises a gate coupled to the source of TFT 101, a drain, and a source coupled to a voltage source Vdd. A capacitor 105 is coupled between the gate of TFT 103 and the source of TFT 103. A light-emitting element 107 is coupled between the drain of TFT 103 and a voltage source Gnd.

TFT 101 is turned on as scan signal S1 is asserted. Therefore, data signal D1 is input to capacitor 105 such that capacitor 105 is charged. When voltage stored by capacitor 105 reaches a preset value, TFT 103 is turned on such that light-emitting element 107 is lit.

If TFT 103 is desired to operate in a saturation region, voltage difference Vds across the drain of TFT 103 and the source thereof is defined in the following.

$$Vds>Vgs-Vth;$$

Wherein, Vgs is voltage difference across the gate of TFT 103 and the source of thereof and Vth is threshold voltage of TFT 103.

Assuming Vgs equals −5V and Vth equals −1.5V. To operate TFT 103 in the saturation region, the voltage difference Vds is required to exceed 3.5V.

If voltage difference across light emitting element 107 equals 6V, light-emitting element 107 displays maximum brightness. Therefore, voltage difference V103 between nodes N1 and N2 is required to exceed 9.5V such that TFT 103 can be operated in the saturation region and light-emitting element 107 displays maximum brightness.

SUMMARY

Pixel units and display panels and electronic devices utilizing the same are provided. An exemplary embodiment of a pixel unit comprises first and second thin film transistors, a capacitor, and a light-emitting device. The first thin film transistor comprises a first control terminal receiving a scan signal, a first electrode receiving a data signal, and a second electrode. The second thin film transistor comprises a second control terminal coupled to the second electrode, a third electrode receiving a first voltage, a fourth electrode, and a fifth electrode coupled to one of the third and the fourth electrodes. The capacitor is coupled between the second control terminal and the third electrode. The light-emitting device is coupled between the fourth electrode and a second voltage.

Display panels with pixel units are also provided. An exemplary embodiment of a display panel with pixel units comprises gate electrodes, source electrodes, and pixel units. The gate electrodes receive a plurality of scan signals. The source electrodes receive a plurality of data signals. The pixel units receive the corresponding scan signal and the corresponding data signal. Each pixel unit comprises first and second thin film transistors, a capacitor, and a light-emitting device. The first thin film transistor comprises a first control terminal receiving the corresponding scan signal, a first electrode receiving the corresponding data signal, and a second electrode. The second thin film transistor comprises a second control terminal coupled to the second electrode, a third electrode receiving a first voltage, a fourth electrode, and a fifth electrode coupled to one of the third and the fourth electrodes. The capacitor is coupled between the second control terminal and the third electrode. The light-emitting device is coupled between the fourth electrode and a second voltage.

Electronic devices with pixel units are also provided. An exemplary embodiment of an electronic device with pixel units comprises a gate driver, a scan driver, and a display panel. The gate driver supplies a plurality of scan signals. The scan driver supplies a plurality of data signals. The display panel comprises gate electrodes, source electrodes, and pixel units. The gate electrodes receive the scan signals. The source electrodes receive the data signals. Each pixel unit receives the corresponding scan signal and the corresponding data signal and comprises first and second thin film transistors, a capacitor, and a light-emitting device. The first thin film transistor comprises a first control terminal receiving the corresponding scan signal, a first electrode receiving the corresponding data signal, and a second electrode. The second thin film transistor comprises a second control terminal coupled to the second electrode, a third electrode receiving a first voltage, a fourth electrode, and a fifth electrode coupled to one of the third and the fourth electrodes. The capacitor is coupled between the second control terminal and the third electrode. The light-emitting device is coupled between the fourth electrode and a second voltage.

DESCRIPTION OF THE DRAWINGS

The invention can be more fully understood by reading the subsequent detailed description and examples with reference made to the accompanying drawings, wherein.

DETAILED DESCRIPTION

Figure 2:
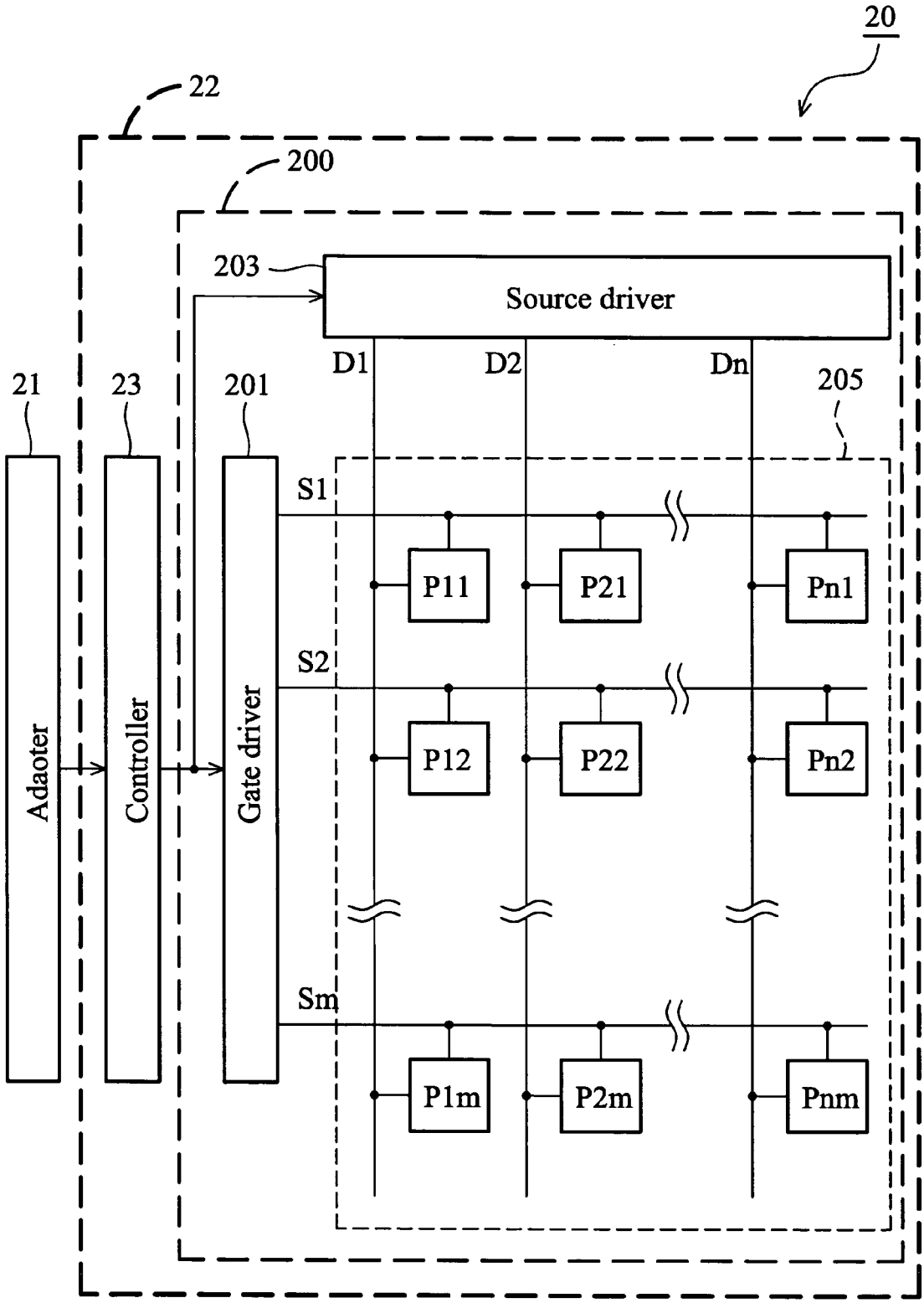
FIG. 2 is a schematic diagram of an exemplary embodiment of an electronic device.

FIG. 2 is a schematic diagram of an exemplary embodiment of an electronic device. Electronic device 20 comprises an adapter 21 and a display device 22. Adapter 21 supplies power and drives display device 22. Display device 22 comprises a controller 23 and a display panel 200. Controller 23 controls display panel 200 for displaying image.

Display panel 200 comprises a gate driver 201, a source driver 202, and a display area 205. Gate driver 201 supplies scan signals S1~Sm. Source driver 202 supplies data signals D1~Dn. Display area 205 comprises gate electrodes, source electrodes, and pixel units P11~Pnm. The gate electrodes receive scan signals S1~Sm and the source electrodes receive data signals D1~Dn. The interlaced gate electrode and source electrode controls a single pixel unit.

Figure 3:
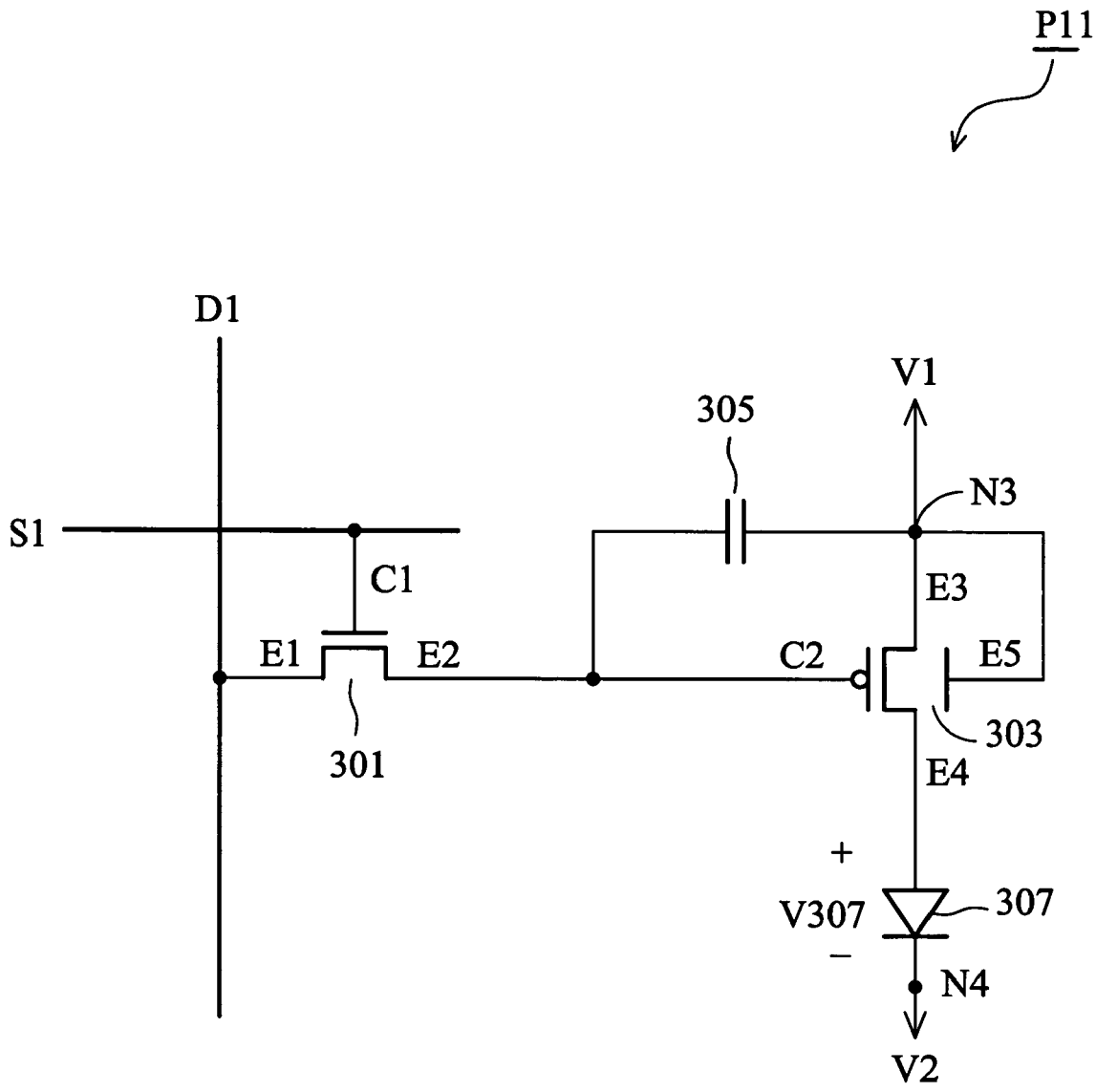
FIG. 3 is a schematic diagram of an exemplary embodiment of a pixel unit.

FIG. 3 is a schematic diagram of an exemplary embodiment of a pixel unit. The structures of pixel units P11-Pnm are the same hence pixel unit P11 is given as an example.

Pixel unit P11 comprises TFTs 301 and 303, a capacitor 305, and a light-emitting device 307. TFT 301 comprises a control terminal C1 receiving scan signal S1, an electrode E1 receiving data signal D1, and an electrode E2. TFT 303 comprises a control terminal C2 coupled to the electrode E2, an electrode E3 receiving voltage V1, an electrode E4, and an electrode E5 coupled to one of the electrodes E3 and E4. In this embodiment, since TFT 303 is a P type, the electrode E5 is coupled to the electrode E3.

Capacitor 305 is coupled between the control terminal C2 and the electrode E3. Light-emitting device 307, such as an organic light emitting diode (OLED) or a polymer light emitting diode (PLED), is coupled between the electrode E4 and voltage V2. In this embodiment, the level of voltage V1 exceeds that of voltage V2.

The threshold voltage Vth of TFT 303 is reduced as the electrode E5 is coupled to the electrode E3. If the threshold voltage Vth of TFT 303 equals −3V and the voltage difference Vgs across the control terminal C2 and the electrode E3 equals −5V, the voltage difference Vds across the electrodes E4 and E3 equals approximately −2V such that TFT 303 operates in the saturation region.

Additionally, light-emitting device 307 displays maximum brightness when the voltage difference V307 across light-emitting device 307 equals 6V. Therefore, the voltage difference between nodes N3 and N4 equals approximately 8V.

Figure 4:
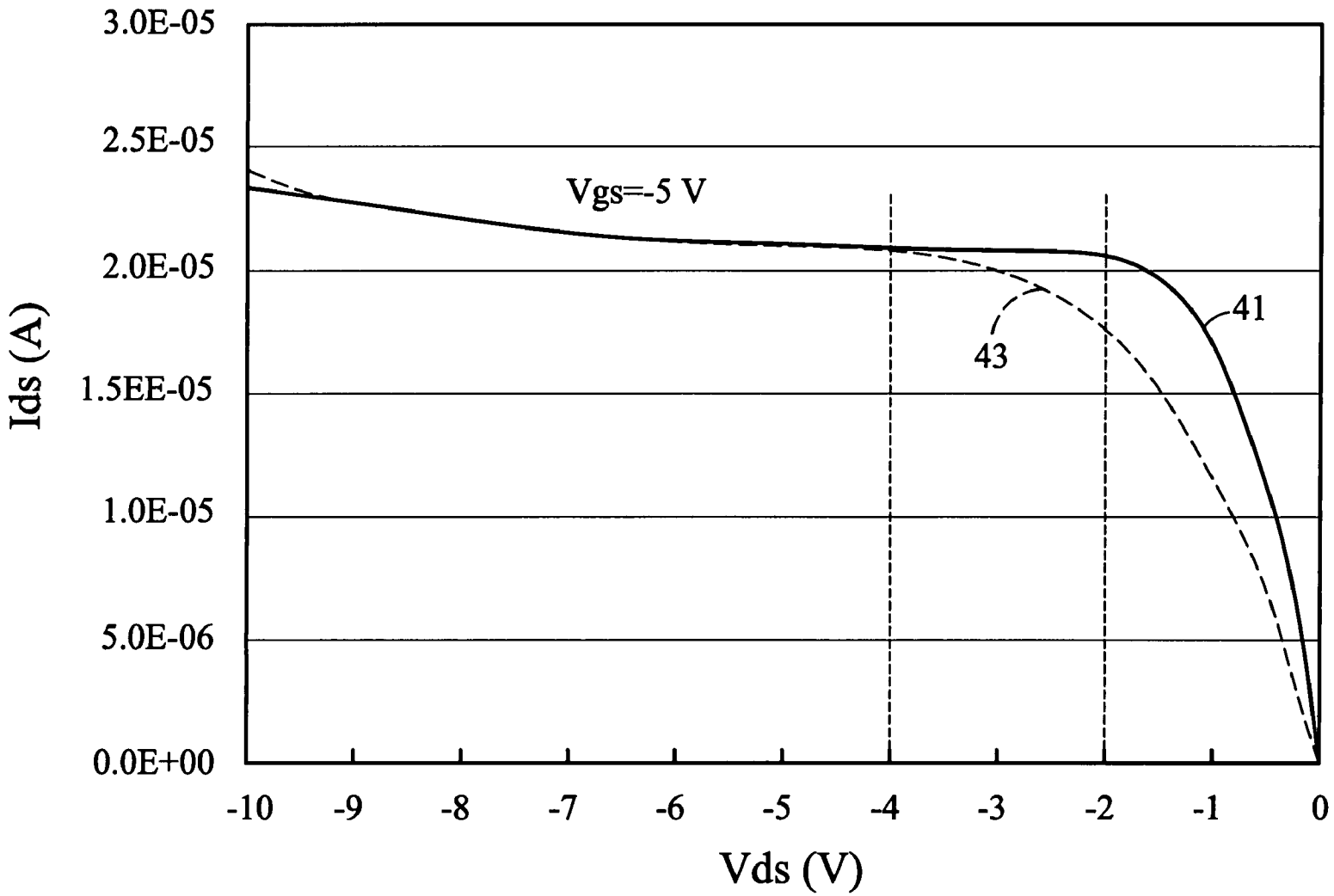
FIG. 4 shows characteristic curves related to TFTs 103 and 303.

FIG. 4 shows characteristic curves related to TFTs 103 and 303. When the voltage difference Vgs across the control terminal C2 and the electrode E3 equals −5V, curve 41 is a characteristic curve related to the voltage difference Vds and current Ids, wherein the voltage difference Vds is across the electrodes E3 and E4 and the current. Ids flows from the electrode E3 to the electrode E4.

TFT 303 can be operated in the saturation region as the voltage difference Vds across the electrodes E3 and E4 equals approximately −2V. Therefore, the current Ids through from the electrode E3 to the electrode E4 equals approximately $2.3\times10^{-5}$ A.

When the voltage difference Vgs across the control terminal C2 of TFT 103 and the electrode E3 of thereof equals −5V, curve 43 is a characteristic curve related to the voltage difference Vds and current Ids, wherein the voltage difference Vds is across the electrode E3 of TFT 103 and the electrode E4 thereof and the current Ids flows from the electrode E3 of TFT 103 and the electrode E4 thereof.

TFT 103 can be operated in the saturation region as the voltage difference Vds across the electrode E3 of TFT 103 and the electrode E4 thereof equals approximately −4V. Therefore, the current Ids through from the electrode E3 of TFT 103 to the electrode E4 thereof equals approximately $2.3\times10^{-5}$ A.

Figure 1:
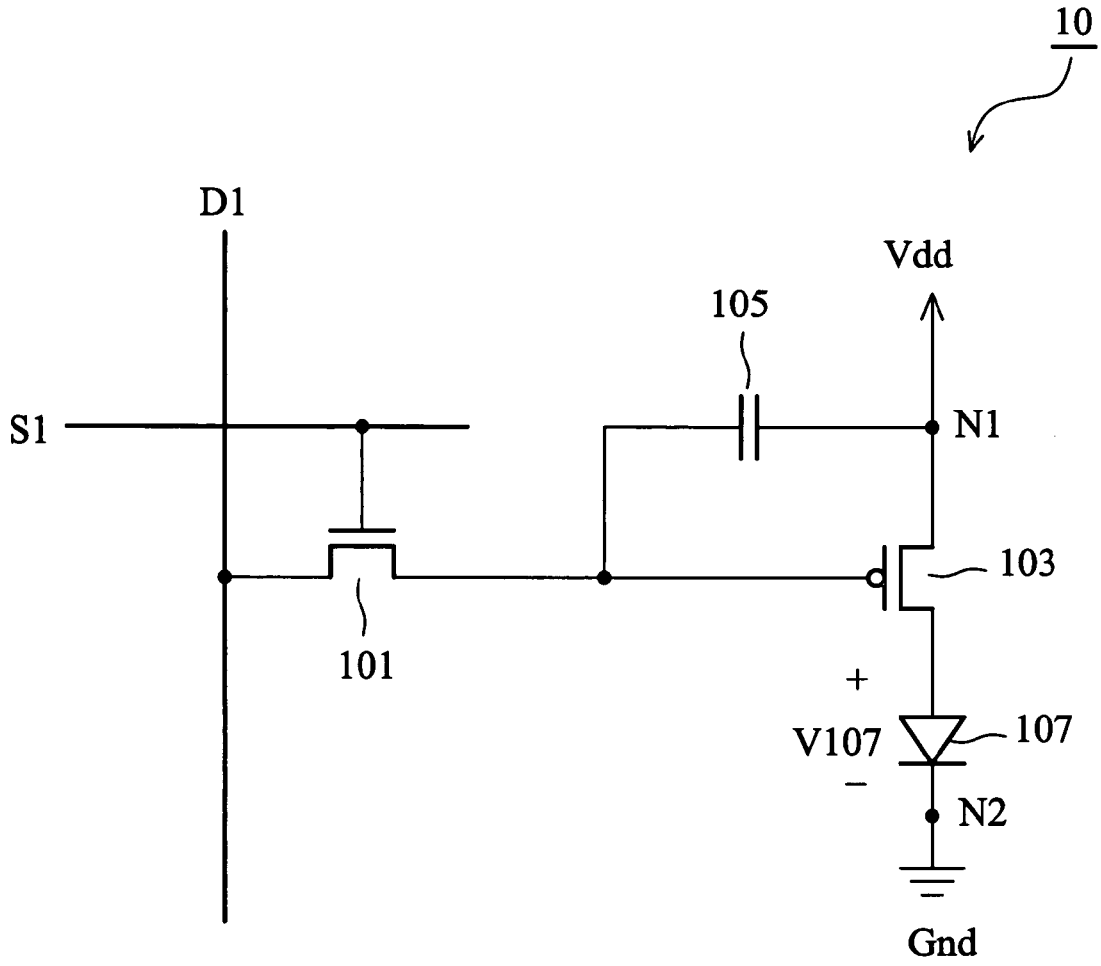
FIG. 1 ( RELATED ART )
FIG. 1 is a schematic diagram of a conventional pixel unit.

As shown in FIGS. 1 and 3, as the voltage difference Vds across the source of TFT 103 and the drain thereof equals approximately −4V, TFT 103 can be operated in the saturation region and the current Ids through from the source of TFT 103 to the drain thereof equals approximately $2.3\times10^{-5}$ A and as the voltage difference Vds across the electrodes E3 and E4 equals approximately −2V, TFT 303 can be operated in the saturation region and the current Ids through from the electrode E3 to the electrode E4 equals approximately $2.3\times10^{-5}$ A. Therefore, wasted power of TFT 303 is less than that of TFT 103.

Figure 5:
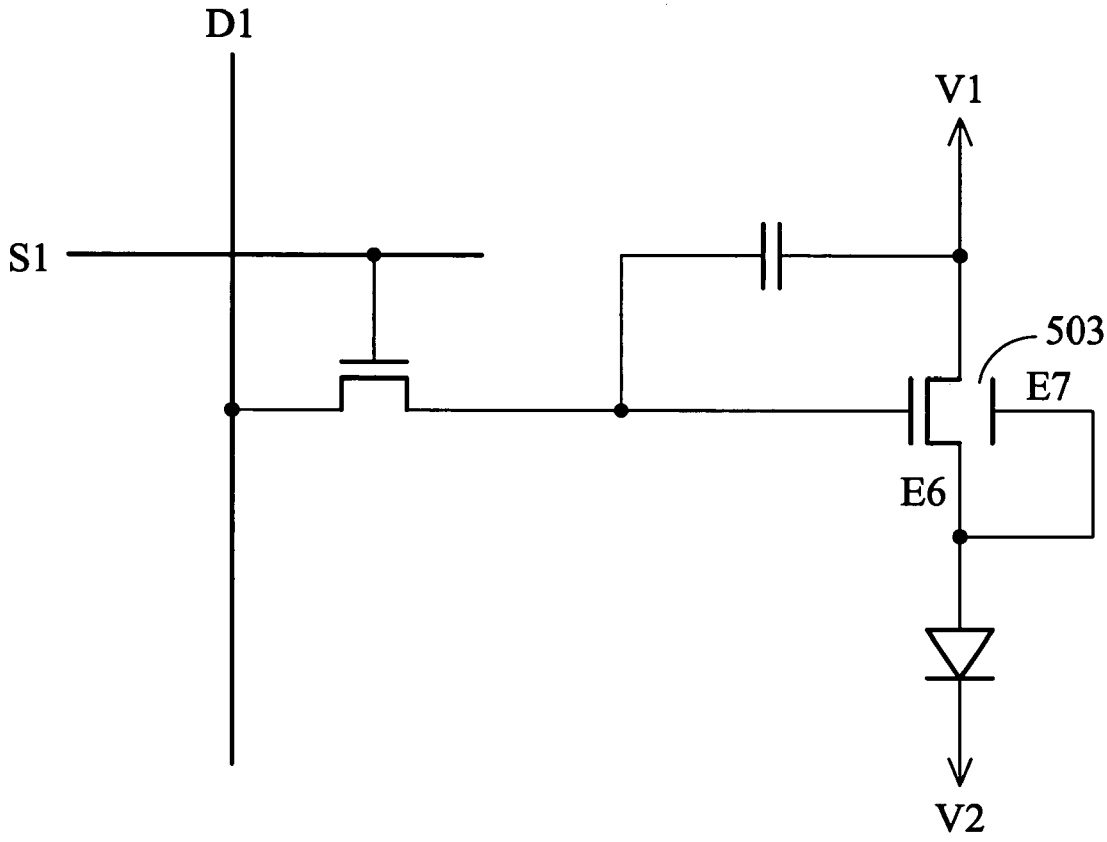
FIG. 5 is a schematic diagram of another exemplary embodiment of a pixel unit.

FIG. 5 is a schematic diagram of another exemplary embodiment of a pixel unit. FIG. 5 is similar to the FIG. 3 except that TFT 503 is N type and the electrode E7 of TFT 503 is coupled to the electrode E6 thereof.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A pixel unit comprising:
a first thin film transistor comprising a first control terminal receiving a scan signal, a first electrode receiving a data signal, and a second electrode;
a second thin film transistor comprising a second control terminal coupled to the second electrode, a third electrode receiving a first voltage, a fourth electrode, and a fifth electrode;
a capacitor coupled between the second control terminal and the third electrode; and
a light-emitting device directly electrically connected between the fourth electrode and a second voltage, wherein the fifth electrode is coupled to the fourth electrode as the second thin-film transistor is an N-type, and the fifth electrode is coupled to the third electrode as the second thin-film transistor is a P-type.

2. The pixel unit as claimed in claim 1, wherein the light-emitting device is one of an organic light emitting diode (OLED) and a polymer light emitting diode (PLED).

3. The pixel unit as claimed in claim 1, wherein the level of the first voltage exceeds that of the second voltage as the second thin-film transistor is a P-type.

4. A display panel comprising:
a gate driver supplying a plurality of scan signals;
a source driver supplying a plurality of data signals;
a display area comprising:
a plurality of gate electrodes receiving the scan signals;
a plurality of source electrodes receiving the data signals; and
a plurality of pixel units as claimed in claim 1, each pixel unit receiving the corresponding scan signal and the corresponding data signal.

5. The display panel as claimed in claim 4, wherein the light-emitting device is one of an organic light emitting diode (OLED) and a polymer light emitting diode (PLED).

6. The display panel as claimed in claim 4, wherein the level of the first voltage exceeds that of the second voltage as the second thin-film transistor is a P-type.

7. A display device comprising:
a display panel as claimed in claim 4; and
a controller controlling the display panel for displaying an image.

8. An electronic device comprising:
a display device as claimed in claim 7; and
an adapter driving the display device.

* * * * *